United States Patent [19]

Takahashi et al.

[11] Patent Number: 4,686,548

[45] Date of Patent: Aug. 11, 1987

[54] PRESSURE-SENSITIVE RECORDING MATERIAL

[75] Inventors: Naoya Takahashi, Yokohama; Keiji Endo, Yokosukashi; Eiichi Matsuzaka, Kawasaki; Satoshi Narui, Ayase; Atsushi Sato, Tokyo, all of Japan

[73] Assignee: Nippon Petrochemicals Company, Limited, Japan

[21] Appl. No.: 745,317

[22] Filed: Jun. 14, 1985

[30] Foreign Application Priority Data

Jun. 21, 1984 [JP] Japan ..... 59-128168

[51] Int. Cl.[4] ..... B41M 5/16; B41M 5/22

[52] U.S. Cl. ..... 503/213; 503/200; 503/225; 427/150; 427/151

[58] Field of Search ..... 346/200, 209, 213, 225, 346/215; 427/150–152

[56] References Cited

U.S. PATENT DOCUMENTS 3,836,383 9/1974 Kiritani et al. ..... 346/213

3,936,566 2/1976 Sato et al. ..... 346/213

4,390,194 6/1983 Sato et al. ..... 346/213

*Primary Examiner*—Bruce H. Hess

*Attorney, Agent, or Firm*—Scully, Scott, Murphy & Presser

[57] ABSTRACT

A pressure-sensitive recording material of the type which is prepared by using an electron donating dye-precursor that produces a color when the dye-precursor is brought into contact with an electron accepting color developer. The pressure-sensitive recording material is characterized in that the solvent for said dye-precursor comprises an alkylated fraction which is prepared by alkylating a by-product fraction with at least one alkyl group having 1 to 5 carbon atoms, the by-product fraction containing the components within the boiling range of 255° to 300° C. on the atmospheric pressure basis and being obtained in the process for producing ethylbenzene or ethyltoluene from ethylene and benzene or toluene. The pressure-sensitive recording material of the invention has scarcely offensive odor and can develop a dense color with a higher color developing rate.

6 Claims, No Drawings

PRESSURE-SENSITIVE RECORDING MATERIAL

BACKGROUND OF THE INVENTION (1) Field of the Invention

This invention relates to a pressure-sensitive recording material. More particularly, the invention relates to a pressure-sensitive recording material which comprises a sheet material having thereon a layer of microcapsules containing an electron donating dye-precursor and a specific solvent for the dye-precursor.

(2) Description of the Prior Art

Various kinds of pressure-sensitive recording materials are hitherto well known. For example, to one sheet of paper are applied microcapsules containing a solution of an electron donating colorless chromogenic substance (hereinafter referred to as "dye-precursor"), and to another sheet of paper is applied an electron accepting substance such as clay or polymeric material (hereinafter referred to as "color developer") which produces a color upon reacting with the dye-precursor. When a recording material is used, the treated surfaces of the above set of sheets are put together face to face and local pressure is applied to the paired sheets by handwriting or typewriting, thereby obtaining desired duplicate impressions.

The recording mechanism in the pressure-sensitive recording material of the type described above is such that the microcapsules are ruptured by the pressure of handwriting or the impact of typewriting to release the dye-precursor solution from the microcapsules. The solution containing a dye-precursor comes into contact with the color developer on the opposing surface of the other sheet of paper to produce a color.

In another type of known recording material, the microcapsule layer is applied to one side of a sheet of paper as an inner layer, and a color developer is then applied as an outer layer over the microcapsule layer. The dye-precursor solution that is used for the recording material of this kind is a solution of an electron donating dye-precursor in one or more kinds of hydrophobic solvents. The hydrophobic solvents employed here are required to have the properties as follows:

(a) innoxiousness, (b) inexpensiveness,
(c) absence of disagreeable odor,
(d) colorlessness or quite light color, (e) non-volatility,
(f) good dissolving property (solvent power) for dye-precursors, (g) good stability of dye-precursor solution,
(h) to produce stable dispersion of fine particles of solution in microcapsule formation,
(i) to produce microcapsule membranes over the above finely dispersed particles,
(j) good storage stability of microcapsules,
(k) to form an uniform microcapsule layer in a desired thickness on a substrate,
(l) not to inhibit the color developing reaction between a dye-precursor and a color developer, and the color developing rate is high,
(m) when a paper sheet coated with polymeric material as a color developer is used, to dissolve also the polymeric material, thereby causing close contact of the material with a dye-precursor,
(n) to produce clear duplicate impressions without runs, and (o) to produce duplicate impressions which are maintained as they stand for a long period of time without any deterioration.

In the prior art, polychlorinated biphenyl was widely used as the solvent for producing the microcapsules for these pressure-sensitive recording materials. The polychlorinated biphenyl has indeed several excellent properties as a solvent of this kind; however, it has a serious disadvantage in that it is quite toxic and hardly decomposed and the accumulation in living bodies is liable to occur.

As an inexpensive solvent for dye-precursors to replace the polychlorinated biphenyl, there is proposed a method to employ a heavier fraction that is obtained as a by-product in ethylbenzene production process.

That is, disclosed in Japanese Laid-Open Patent Publication No. 56-161195 is that an ethylbenzene heavy end obtained in a ethylbenzene production process is subjected to reduced pressure distillation to remove heavier components and it is then brought into contact with an active clay. The clay-treated product is again distilled under a reduced pressure to obtain a fraction having a boiling range of 265° to 280° C. This fraction is used as a solvent for dye-precursors.

The solvent obtained by this method, however, gives out an offensive smell and it is unfit for use. According to the disclosure in the above-mentioned reference, inventors intended to improve the odor by adding refined vegetable oils, however, any satisfactory result could not be obtained.

BRIEF SUMMARY OF THE INVENTION

It is, therefore, the primary object of the present invention to provide an improved pressure-sensitive recording material in which a specific solvent that is free from the above-described disadvantages is used.

Another object of the present invention is to provide a pressure-sensitive recording material which is inexpensive, gives almost no odor, has a high color developing rate, and can produce clear and dense duplicate images.

A further object of the present invention is to provide a pressure-sensitive recording material which is prepared by using a specific solvent for dye-precursor, which solvent has neither toxicity nor disagreeable odor and has excellent dissolving property and color developing characteristics, and gives good storage stability of microcapsules and recording materials.

In accordance with the present invention, the pressure-sensitive recording material comprises a sheet material having thereon a layer of microcapsules containing an electron donating dye-precursor and a specific solvent for the dye-precursor.

The specific solvent used in the present invention is an alkylated fraction which is prepared by alkylating a by-product fraction with at least one alkyl group having to 5 carbon atoms, said by-product fraction containing the components within the boiling range of 255° to 300° C. on the atmospheric pressure basis and being obtained as a by-product in the process for producing ethylbenzene or ethyltoluene from ethylene and benzene or toluene.

DETAILED DESCRIPTION OF THE INVENTION

The process for producing ethylbenzene or ethyltoluene is carried out by alkylation of benzene or toluene with ethylene.

The alkylation catalysts used for this reaction are cationic alkylation catalysts and are exemplified by Lewis acid catalysts such as aluminum chloride, solid phosphoric acid catalyst, silica-alumina catalyst and zeolite catalyst. Any heavier by-product fractions from ethylbenzene or ethyltoluene production processes can be used in the present invention even when any one of the above catalysts is employed.

In the present invention, it is necessary that a fraction containing the components within a boiling range of 255° to 300° C. on the atmospheric pressure basis in heavier by-products is used for alkylation. The fraction having boiling points lower than 255° C. is mainly composed of polyethylbenzenes or polyethyltoluenes. When such the fraction is used after alkylation, the excellent pressure-sensitive recording material according to the present invention cannot be obtained. Meanwhile, the alkylation product of a fraction having boiling points above 300° C. has a too high viscosity and it is not suitable as a solvent for dye-precursors. In addition, it is not desirable that the consumption of catalyst in alkylation is large. Furthermore, when aluminum chloride catalyst is used in the ethylbenzene or ethyltoluene production, the heavier portion in a heavier by-product is not desirable because it contains acidic sludge.

In the above-mentioned fraction within a boiling range of 255° to 300° C., diphenylalkanes and/or alkyldiphenylalkanes are contained as main components.

It is desirable to perform the above addition of alkyl groups by alkylating the foregoing fraction with an alkylating agent in the presence of an alkylation catalyst. As the alkylating agents, any suitable material can be employed as far as it can alkylate the above by-product fraction with at least one alkyl group having 1 to 5 carbon atoms. For example, olefins such as propylene and butene, alkyl halides such as isopropyl chloride and sec-butyl chloride, and alcohols such as propyl alcohol and amyl alcohol can be used. The number of carbon atoms in the alkylating agent is not limited to 1 to 5 as far as the carbon atom numbers of added alkyl groups are 1 to 5. For example, tert-butyl groups can be introduced by an alkylating agent of diisobutylene in the presence of aluminum chloride complex catalyst.

The alkyl groups thus added are, for example, methyl, ethyl, n-propyl, iso-propyl, n-butyl, iso-butyl, sec-butyl, tert-butyl and amyl or the like.

In the alkylation, the addition of alkyl groups having 6 or more carbon atoms is not desirable because the viscosity of an obtained fluid is high and the dissolving power with regard to dye-precursors is not high. Therefore, such the alkylation products are not suitable for use in the present invention as the solvents for dye-precursors.

As the alkylation catalysts, known ones may be used. For example, Lewis acids such as metal halides, inorganic acids such as sulfuric acid and phosphoric acid, and solid acids such as silica-alumina, alumina boria, zeolite and cation exchange resin.

In connection with reaction conditions such as a reaction temperature, reaction time and the ratio of alkylating agent to a fraction to be alkylated can be determined properly in compliance with the characteristics of a catalyst to be employed.

The specific solvents used in the present invention are materials mainly containing diarylalkanes having at least one alkyl group of 1 to 5 carbon atoms, especially, they comprises alkylation products of diphenylmethane and diphenylethane as the main components from the ethylbenzene by-product fraction or alkylation products of phenyltolylmethane and phenyltolylethane from the ethyltoluene by-product fraction.

The alkylation products of diphenylmethane are exemplified by ethyldiphenylmethane, isopropyldiphenylmethane, and butyl or amyldiphenylmethane. The alkylation products of diphenylethane are exemplified by ethyldiphenylethane, isopropyldiphenylethane and butyldiphenylethane.

Japanese Patent Publication No. 53-48126 discloses a method for producing 1-phenyl-1-isopropylphenylethane which is prepared by styrylation of cumene.

The fraction containing 1-phenyl-1-isopropylphenylethane that is prepared according to the present invention has excellent color-producing property and has a less odor as compared with the 1-phenyl-1-isopropylphenylethane that is obtained according to the method described in the above patent publication. Furthermore, the odor of the fraction containing 1-phenyl-1-isopropylphenylethane prepared according to the present invention is better than that of phenylxylylethane.

It should be noted further that the number of carbon atoms in the alkyl groups can be properly selected in compliance with properties such as flash point, viscosity and pour point that are required for a solvent for dye-precursors. These properties can be controlled by distilling the reaction product that was obtained by alkylating the foregoing fraction. In view of the above-mentioned properties, an alkylated fraction within a boiling range of 270° to 335° C. on atmospheric pressure basis is preferable.

The specific solvent used in the present invention is advantageous in that it has a less odor than the solvent disclosed in the foregoing Japanese Laid-Open Patent Publication No. 56-161195. In addition, the specific solvent according to the invention is advantageous as a solvent for dye-precursors because of the good solubility for dye-precursors.

The specific solvents according to the present invention can be used singly or in combination of two or more kinds of other solvents. They can be used also by being mixed with other liquids so long as the properties as the solvents are not impaired. For example, the specific solvent can be used as a mixture with kerosene.

As the dye-precursors, there are typically triarylmethane type compounds, diphenylmethane type compounds, xanthene type compounds, thiazine type compounds, and spiropyran type compounds.

The dye-precursors of triarylmethane type compounds are exemplified by:

3,3-bis(p-dimethylaminophenyl)-6-dimethylaminophthalide (Crystal Violet Lactone);

3,3-bis(p-dimethylaminophenyl)phthalide;

3-(p-dimethylaminophenyl)-3-(1,2-dimethylindole-3-yl)phthalide;

3-(p-dimethylaminophenyl)-3-(2-methylindole-3-yl)phthalide;

3-(p-dimethylaminophenyl)-3-(2-phenylindole-3-yl)phthalide;

3,3-bis(1,2-dimethylindole-3-yl)-5-dimethylaminophthalide;

3,3-bis(1,2-dimethylindole-3-yl)-6-dimethylaminophthalide;

3,3-bis(9-ethylcarbazole-3-yl)-5-dimethylaminophthalide;

3,3-bis(2-phenylindole-3-yl)-5-dimethylaminophthalide; and 3-p-dimethylaminophenyl-3-(1-methylpyrrole-2-yl)-6-dimethylaminophthalide.

The dye-precursors of diphenylmethane type compounds are exemplified by:

4,4-bis-dimethylaminobenzhydrine benzyl ether; N-halophenyl leuco Auramine; and N-2,4,5-trichlorophenyl leuco Auramine.

The xanthene type dye-precursors are exemplified by:

Rhodamine B-anilinolactam;
Rhodamine B-(p-nitroanilino)lactam;
Rhodamine B-(p-chloroanilino)lactam;
3-dimethylamino-6-methoxyfluoran;
3-diethylamino-7-methoxyfluoran;
3-diethylamino-7-chloro-6-methylfluoran;
3-diethylamino-7-(acetylmethylamino)fluoran;
3-diethylamino-7-(dibenzylamino)fluoran;
3-diethylamino-7-(methylbenzylamino)fluoran;
3-diethylamino-7-(chloroethylmethylamino)fluoran;
3-diethylamino-7-(diethylamino)fluoran; and
3-diethylamino-6-methyl-7-anilinofluoran.

The thiazine type dye-precursors are exemplified by: benzoyl leuco methylene blue and p-nitrobenzoyl leuco methylene blue.

The spiro type dye-precursors are exemplified by:

3-methyl-spiro-dinaphthopyran; 3-ethyl-spiro-dinaphthopyran;
3,3'-dichloro-spiro-dinaphthopyran;
3-benzyl-spiro-dinaphthopyran;
3-methylnaphtho-(3-methoxybenzo)spiropyran; and
3-propyl-spiro-dibenzodipyran.

The dye-precursors can be dissolved into the solvent of the invention in the manner likewise the use of conventional solvents.

As the electron accepting color developer, there are clay, polymers, and aromatic carboxylic acids or their metal salts.

The polymers are exemplified by phenol-aldehyde polymer, phenol-acetylene polymer, maleic acid-rosin polymer, partially or completely hydrolyzed styrene-maleic anhydride copolymer, partially or completely hydrolyzed ethylenemaleic anhydride copolymer, carboxy polyethylene, and partially or completely hydrolyzed vinyl methyl ether-maleic anhydride copolymer.

The examples of aromatic carboxylic acids and their derivatives are exemplified by:

3,5-di(α-methylbenzyl)salicylic acid;
3-(α-methylbenzyl)-5-(α,α-dimethylbenzyl)salicylic acid;
3-(4'-α',α'-dimethylbenzyl)phenyl-5-(α,α-dimethylbenzyl)salicylic acid; 3,5-di-tert-butyl salicylic acid;
3,5-di-tert-octyl salicylic acid;
3-cyclohexyl-5-(α,α-dimethylbenzyl)salicylic acid;
3-phenyl-5-(α,α-dimethylbenzyl)salicylic acid; and
3,5-di(α,α-dimethylbenzyl)salicylic acid. Furthermore, their salts of polyvalent metals such as zinc, aluminum, barium, tin, iron, calcium and lead can also be used.

As the method to prepare the microcapsules of the dye-precursor solution, which is obtained by dissolving a dye-precursor into the solvent, there is a coacervation method in which the fine particles of the dye-precursor solution that are dispersed in water are coated by a protective colloidal material such as gelatin or gum arabic, thereby obtaining the microcapsules which contain therein the dye-precursor solution. Another method is the interfacial polymerization method or a in situ polymerization method in which a monomer or a partially condensed polymerizable product is employed and a polymerization initiator, an accelerator or a catalyst is added to cause polymerization on the surfaces of fine particles of the dye-precursor solution, thereby preparing the microcapsules containing the dye-precursor solution. The specific solvent of the present invention can be used in any one of the above methods.

In the practical process for preparing microcapsules in the conventional art, an auxiliary solvent has been used in dissolving a dye-precursor in order to control the viscosity and volatility of the dye-precursor solution, the particle size of the fine dispersion in microcapsule formation, the dissolving property to the polymeric material that is coated onto the surface to be recorded, and the rate of color development. However, the specific solvent of the present invention can satisfactorily be used without employing such an auxiliary solvent. Nevertheless, any solvent which does not degrade the characteristics of the solvent of the present invention may be used as an auxiliary solvent. It should be noted also that the specific solvent of the present invention can be used together with conventional solvents.

As described in the foregoing paragraphs and in the appended claims, the pressure-sensitive recording material of the present invention is characterized in the use of the specific solvent. Namely the present invention is characterized in the use of the fraction as the solvent for the dye-precursor, which is obtained by adding at least one alkyl group having 1 to 5 carbon atoms to the fraction within a boiling range of 255° to 300° C. on the atmospheric pressure basis that is by-produced in the process for producing ethylbenzene or ethyltoluene from ethylene and benzene or toluene.

This solvent fraction mainly comprises alkyladducts of diarylalkanes but it contains small quantities of other accompanying components derived from the ethylbenzene or ethyltoluene production process.

Even through the detail mechanisms are not clear, the mutual reaction or synergistic effects between these accompanying components and the main component and the electron donating dye-precursor may be responsible to the improvement of the functions such as the color developing rate and the color density when using the solvent of the present invention. Therefore, the pressure sensitive recording material having quite excellent characteristics can be obtained.

The present invention will be described in more detail with reference to examples.

EXAMPLE 1

A heavier by-product in ethylbenzene production using aluminum chloride catalyst was distilled to obtain a fraction having a boiling range from 270° to 290° C. (atmospheric pressure) containing diphenylethane as a main component.

This fraction was then alkylated at 130° C. using propylene in the presence of cation exchange resin as a catalyst. The reaction product was distilled under reduced pressure to obtain a fraction having a boiling range of 290° to 310° C. (atmospheric pressure). This fraction mainly contained 1-phenyl-1-isopropylphenylethane.

With regard to this fraction, odor, physical properties and characteristics as a solvent for a dye-precursor of pressure-sensitive recording paper were tested, the results of which are shown in the following Table 2.

The judgement for odor was made by ten test panels and evaluated as follows:

| | |
|---|---|
| Strong disagreeable odor: | −1 |
| Disagreeable odor but allowable: | 0 |
| No disagreeable odor: | 1 |

The evaluation for the performance as a solvent for dye-precursor of pressure-sensitive recording paper was carried out as follows:

A 3% solution of crystal violet lactone (CVL) as a dye-precursor was prepared. A microcapsule emulsion was prepared using this solution by complex coacervation method. CB paper was made by uniformly applying the obtained emulsion to fine quality paper with a wire bar. The dried CB paper was then superposed on resin-coated CF paper and they were pressed together by a high-pressure press to develop the color over the CF surface. Initial color density was determined 1 minute after the pressing and final color density, 1 hour after pressing.

The color density was determined by a color-difference meter. With the reflection coefficient of magnesium oxide as 100, reflection coefficients of CF paper before color developing and the respective times after color developing were determined. The color densities were calculated by the following equation:

$$\text{Color Density} = \frac{(RC-I)-(RC-II)}{(RC-I)} \times 100$$

where RC-I was the reflection coefficient of CF paper before color developing and RC-II was the reflection coefficient of CF paper after color developing.

The results were represented by the following criteria in Table 1.

TABLE 1

| | Criteria for Color Densities | |
|---|---|---|
| Judgement | Color Density after 1 minute | Color Density after 1 hour |
| A | 65 or higher | 70 or higher |
| B | 60–64 | 60–69 |
| C | 55–59 | 59 or lower |
| D | 54 or lower | — |

COMPARATIVE EXAMPLE 1

Aralkylation of cumene with styrene was carried out in the presence of sulfuric acid catalyst. From the reaction product, a fraction mainly containing 1-phenyl-1-(isopropylphenyl)ethane was obtained by distillation.

The odor and characteristics as a solvent for pressure-sensitive recording paper were tested in the like manner as Example 1, the results of which are shown in the following Table 2.

As will be understood from Table 2, the odor of the solvent in Example 1 according to the present invention was superior to the solvent prepared in Comparative Example 1. Furthermore, the solvent of the invention was better in view of color developing property and physical properties.

COMPARATIVE EXAMPLE 2

With regard to 1-phenyl-1-xylylethane, the odor and performance as a solvent for pressure-sensitive recording paper were tested in the like manner as Example 1. The results are shown in the following Table 2.

As compare with 1-phenyl-1-xylylethane, the odor of the solvent prepared according to the present invention was better and the properties as a solvent for dye-precursor of pressure-sensitive recording paper were also superior to the 1-phenyl-1-xylylethane.

TABLE 2

| Test Items | Eample 1 | Comp. Ex. 1 | Comp. Ex. 2 |
|---|---|---|---|
| Odor | 4 | 2 | 2 |
| Color Density | | | |
| After 1 min. | A | B | B |
| After 1 hr. | A | A | A |
| Physical Props. | | | |
| Viscosity (c.s. at 40° C.) | 4.7 | 4.8 | 5.1 |
| Pour Point (°C.) | Below −50 | −50 | −47.5 |

EXAMPLE 2

Benzene was alkylated using ethylene in the presence of zeolite catalyst at 410° C. and 20 kg/cm$^2$. From the reaction product, benzene, the main product of ethylbenzene and polyethylbenzene were removed by distillation and a fraction having a boiling range of 255° to 320° C. was obtained as a bottom oil. This fraction was further subjected to alkylation using an n-butene mixture at 160° C. in the presence of a silica-alumina catalyst.

In the succeeding process, a fraction having a boiling range of 295° to 330° C. (atmospheric pressure) was obtained from the reaction product by distillation. The main components of this fraction were sec-butyl diphenylethane and sec-butyl diphenylmethane.

The odor, characteristics and physical properties as a solvent for the dye-precursor of pressure-sensitive recording paper were tested in the like manner as Example 1, the results of which are shown in the following Table 3.

EXAMPLE 3

A fraction in a boiling range of 255° to 290° C. (atmospheric pressure) was obtained from the bottom oil in Example 2. Alkylation of this fraction was carried out at a reaction temperature of 5° C. with propylene as an alkylating agent in the presence of sulfuric acid catalyst.

The reaction product is then subjected to reduced pressure distillation to obtain a fraction having a boiling range of 285° to 320° C. (atmospheric pressure). The main components of this fraction were phenyl-isopropylphenylethane and phenyl-isopropylphenylmethane.

The odor, characteristics and physical properties as a solvent for the dye-precursor of pressure-sensitive recording paper were tested in the like manner as Example 1, the results of which are also shown in the following Table 3.

EXAMPLE 4

A fraction in a boiling range of 270° to 280° C. (atmospheric pressure) containing diphenyl alkanes as the main components was obtained from the bottom oil used in Example 2 by distillation. Alkylation of this fraction was carried out with blowing methyl chloride gas into this fraction in the presence of anhydrous aluminum chloride catalyst. The reaction vessel was ice cooled during the reaction.

The obtained reaction product was then distilled under a reduced pressure to obtain a fraction having a boiling range of 275° to 300° C. (atmospheric pressure). The main component of this fraction was 1-phenyl-1-tolylalkane.

The odor, characteristics and physical properties as a solvent for the dye-precursor of pressure-sensitive recording paper were tested, the results of which are shown in the following Table 3.

COMPARATIVE EXAMPLE 3

A fraction having a boiling range of 270° to 305° C. (atmospheric pressure) was obtained by reduced pressure distillation from the heavier by-product in ethylbenzene production that was used in Example 1. The odor, characteristics and physical properties as a solvent for the dye-precursor of pressure-sensitive recording paper were tested, the results of which are shown in the following Table 3.

As will be understood from Table 3, the fraction prepared in Comparative Example 3 had strong disagreeable odor and it was not fit for use as a solvent. The odor of the pressure-sensitive recording paper using this fraction had also strong odor.

COMPARATIVE EXAMPLE 4

The fraction obtained in Comparative Example 3 was treated by activated clay at room temperature. The treated oil was distilled again under reduced pressure to obtain a fraction having a boiling range of 270° to 310° C. (atmospheric pressure). The odor and other characteristics of this fraction were likewise tested, the results of which are shown in Table 3.

As will be understood from Table 3, even though the properties of the fraction obtained in Comparative Example 4 were improved to some extent as compared with Comparative Example 3, the odor of the fraction is not good as compared with the fractions in Examples 2 to 4 of the present invention.

TABLE 3

| | Example | | | Comp. Exam. | |
|---|---|---|---|---|---|
| Test Items | 2 | 3 | 4 | 3 | 4 |
| Odor | 6 | 5 | 3 | −5 | −3 |
| Color Density | | | | | |
| After 1 min. | A | A | A | A | A |
| After 1 hr. | A | A | A | A | A |
| Physical Props. | | | | | |
| Viscosity (c.s. at 40° C.) | 4.5 | 3.5 | 3.2 | 3.1 | 3.1 |
| Pour Point (°C.) | Below −50 | Below −50 | Below −50 | Below −50 | Below −50 |

EXAMPLE 5

A stainless steel continuous reaction vessel was fed with synthetic zeolite ZSM-5 and toluene was alkylated with ethylene at a reaction temperature of 450° C. under the atmospheric pressure.

The obtained reaction mixture was distilled to remove the fractions below the boiling point of 250° C. containing unreacted toluene, ethyltoluene and polyethyltoluene, thereby obtaining a heavier fraction in a yield of 2.1%.

This heavier fraction was distilled under reduced pressure to obtain a fraction within the boiling range of 265° to 300° C. (atmospheric pressure).

According to analysis, the fraction contained about 83% of phenyltolylmethane and phenyltolylethane.

This fraction was then alkylated using propylene at 160° C. in the presence of silica-alumina catalyst. The reaction product was then distilled under reduced pressure to obtain an alkylated fraction within a boiling range of 290° to 330° C. (atmospheric pressure).

This alkylated fraction mainly contained diarylalkanes having 17 to 19 carbon atoms. By making pressure-sensitive recording paper, the odor and the properties as a solvent for dye-precursors were evaluated in the like manner as Example 1.

The score of odor was 7 and the values of color densities after both 1 minute and 1 hour were "A". Thus, both the odor and coloring property of this example were superior to those of Comparative Examples 1 and 2. Furthermore, as compared with Comparative Examples 3 and 4, though the coloring property is equal, the evaluated value of odor in this Example was quite excellent.

As described above in the Detailed Description of the Invention and in Examples, it is possible to produce pressure-sensitive recording materials which can give clear and dense duplicate images with a higher color developing rate and without toxicity and disagreeable odor. Furthermore, it should be noted that the obtained pressure-sensitive recording materials are not expensive and storage stability of them is good enough.

What is claimed is:

1. In a pressure-sensitive material prepared by using an electron donating dye-precursor which produces a color when said dye-precursor is brought into contact with an electron accepting color developer, the pressure-sensitive recording material being characterized in that the solvent for said dye-precursor comprises an alkylated fraction which is prepared by alkylating a by-product fraction with at least one alkyl group having 1 to 5 carbon atoms, said by-product fraction containing the components within the boiling range of 255° to 200° on the atmospheric pressure basis and being obtained in the process for producing ethylbenzene or ethyltoluene from ethylene and benzene or toluene, said by-product fraction containing diphenylalkanes and/or phenyltolylalkanes.

2. The pressure-sensitive recording material in claim 1, wherein said alkylated fraction is within the boiling range of 270° to 335° C. on the atmospheric pressure basis.

3. The pressure-sensitive recording material in claim 1, wherein said diphenylalkanes are diphenylmethane and/or diphenylethane.

4. The pressure-sensitive recording material in claim 1, wherein said phenyltolylalkanes are phenyltolylmethane and/or phenyltolylethane.

5. The pressure-sensitive recording material in claim 1, wherein said alkyl groups are isopropyl group and/or butyl group.

6. The pressure-sensitive recording material in claim 1, wherein said process for producing ethylbenzene or ethyltoluene is carried out by alkylation of benzene or toluene with ethylene in the presence of aluminum chloride or zeolite catalyst.

* * * * *